US010221555B2

(12) United States Patent
Coronado et al.

(10) Patent No.: US 10,221,555 B2
(45) Date of Patent: Mar. 5, 2019

(54) METHOD AND APPARATUS FOR INSTALLING A FLOOR DRAIN

(71) Applicant: COFLEX S.A. DE C.V., Monterrey, Nuevo Leon (MX)

(72) Inventors: Eduardo Coronado, Nuevo Leon (MX); Javier Canales, Nuevo Leon (MX); Pedro Gonzalez, Nuevo Leon (MX); Humberto Flores-Villarreal, San Pedro Garza Garcia (MX)

(73) Assignee: Coflex S.A. de C.V., Monterrey (MX)

( * ) Notice: Subject to any disclaimer, the term of this patent is extended or adjusted under 35 U.S.C. 154(b) by 435 days.

(21) Appl. No.: 14/874,850

(22) Filed: Oct. 5, 2015

(65) Prior Publication Data

US 2017/0096809 A1 Apr. 6, 2017

(51) Int. Cl.
*E03F 5/04* (2006.01)

(52) U.S. Cl.
CPC ..... *E03F 5/0407* (2013.01); *E03F 5/041* (2013.01); *E03F 2005/0416* (2013.01); *Y10T 29/49826* (2015.01)

(58) Field of Classification Search
CPC . E03F 5/0407; E03F 5/041; E03F 2005/0416; Y10T 29/49826
See application file for complete search history.

(56) References Cited

U.S. PATENT DOCUMENTS 5,190,320 A * 3/1993 Hodges ..... E03D 11/16 285/338
7,921,482 B2 * 4/2011 Shafik ..... E03C 1/122 4/681
2008/0168727 A1 * 7/2008 Ledford ..... E02D 29/14 52/302.3

* cited by examiner

*Primary Examiner* — John C Hong
(74) *Attorney, Agent, or Firm* — Baker & McKenzie LLP

(57) ABSTRACT

A method of installing a drain fixture, the method comprising first installing a sub-floor plumbing system comprising a plumbing trap, a removable drain pipe, and a sleeve. Next, the method comprises connecting the plumbing trap and the removable drain pipe and sliding the sleeve over the removable drain pipe. Next, the method comprises building a flooring surface proximate to the plumbing trap, the removable drain pipe, and the sleeve. Then, the method comprises removing the removable drain pipe at least partly from the sleeve, cutting the removable drain pipe to the desired length, and re-inserting the removable drain pipe through the sleeve and into the plumbing trap.

16 Claims, 9 Drawing Sheets

METHOD AND APPARATUS FOR INSTALLING A FLOOR DRAIN

BACKGROUND

Most homes use basic systems for plumbing and drain systems. A main water line usually comes into a home through its foundation. From this location, the water line may run to a water heater, which generates hot water.

A plumbing drain trap is a shaped pipe located below or within a plumbing fixture such as a toilet, a sink, or a shower drain. A trap can be a U-, S-, or J-shaped trap, although U- and J-shaped traps are the most common traps used today. The various shapes are each named for the bends in the traps, which are used to prevent sewer gases from entering buildings through drain pipes. The bends in the traps are shaped to retain a small amount of water after use of the fixture. The water in the trap creates a seal that prevents sewer gases from passing from the drain pipe back into the building.

However, known plumbing traps have certain disadvantages. Many installations require shallow traps in order to fit against a concrete floor, whether that concrete floor is on a first floor or a basement floor, or for a second story installation. In the United States, basement floors are typically concrete floors so a shallow trap must be used for basement drain fixtures. The height of a trap seal is measured from the bottom of a trap arm at an outlet to the top of the trap dip, also know as the crown weir. A standard trap height may be 50 mm, for example, but a shallow trap may only have a trap height of 15 mm, for example. When a shallow trap is used, however, the amount of water in the trap is decreased compared to the amount in a regular trap, and regular evaporation of water in the trap may cause the water seal to be broken more quickly, thereby allowing sewer odors and gases to enter into the building.

In addition, in some other regions, such as Latin America, floor drains are typically placed next to a toilet in addition to in a shower. While traps connected to a shower drain or a toilet are easy to refill on a regular basis by running the shower or flushing the toilet, in order to maintain a proper seal for a floor drain pipe with a known plumbing trap, water must be poured into the drain on a regular basis. Otherwise, the water within the trap may evaporate and the water seal may be broken if air can pass through the bend in the trap, thereby allowing sewer odors and gasses to enter into the building.

Further, installing floor drains can be difficult because more than one professional is typically involved in the installation process. In a standard installation, a plumber will install the sub-floor plumbing components and then leave a drain pipe extending above an estimated floor height that will extend to a desired fixture. Then, a flooring specialist will finish the flooring above the sub-floor plumbing. Concrete is often poured around the drain pipe and then a finish flooring surface is installed above the concrete. Once the concrete is poured, however, it is difficult, if not impossible, to remove the drain pipe to cut it to the proper height. In order to cut the drain pipe below the flooring surface after the concrete is poured, the flooring specialist must chisel the cement around the drain pipe so that there is sufficient clearance for tools to cut the drain pipe below the flooring surface. But if the drain pipe is cut before the concrete is poured, it is difficult to determine the desired length of the drain pipe necessary to make the floor drain sit flush on the finished flooring surface.

Thus, an improved method for installing a floor drain to the correct height above a flooring slab and a plumbing trap is desired.

BRIEF SUMMARY

In an exemplary embodiment, an improved method of installing a drain fixture is disclosed. The method comprises installing a sub-floor plumbing system. Installing the sub-floor plumbing system comprises connecting a first end of a plumbing trap to a main drain outlet and connecting a first end of a removable drain pipe to a second end of the plumbing trap. The method next comprises sliding a sleeve over the removable drain pipe. Next, the method comprises building a flooring surface above and around the plumbing trap, the removable drain pipe, and the sleeve. Once the floor is built, the method comprises partly or fully removing the removable drain pipe from the sleeve, cutting the removable drain pipe to the desired length and re-inserting the removable drain pipe through the sleeve and into the plumbing trap.

In an exemplary embodiment, an improved plumbing installation kit is disclosed. The kit comprises a plumbing trap, at least one removable drain pipe, at least one sleeve, an optional adapter, an optional washer, an optional cap, and an optional drain pre-form.

BRIEF DESCRIPTION OF THE DRAWINGS

Reference is now made to the following descriptions taken in conjunction with the accompanying drawings.

DETAILED DESCRIPTION

Various aspects of a drainage fitting and related methods for installing a drainage fitting according to the present disclosure are described. It is to be understood, however, that the following explanation is merely exemplary in describing the devices and methods of the present disclosure. Accordingly, any number of reasonable and foreseeable modifications, changes and substitutions are contemplated without departing from the spirit and scope of the present disclosure.

Figure 1:
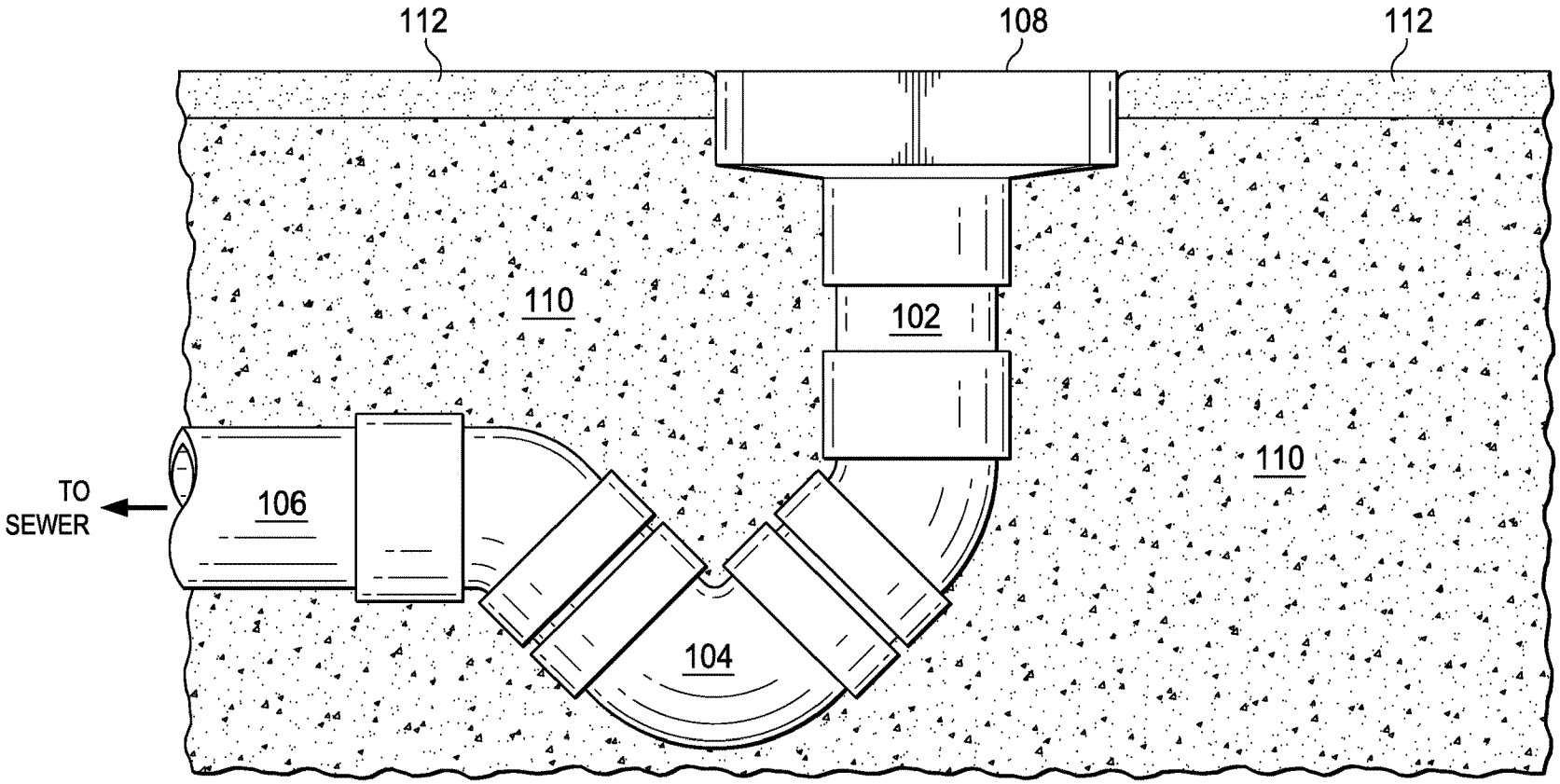
FIG. 1 (PRIOR ART)
FIG. 1 depicts an elevational view of a first prior art floor drain installation.

FIG. 1 depicts an elevational view of a first prior art floor drain installation 100. The first prior art drain installation 100 may comprise a drain pipe 102 extending upwardly from a plumbing trap 104 to a fixture, such as a floor drain 108. The installation 100 may further comprises a drain outlet 106 connected to the main sewer line (not shown). Before the installation 100 is completed, the drain pipe 102 extends above a flooring slab and must be cut to the appropriate length to allow the fixture to sit flush with a finished flooring surface 112.

Figure 2:
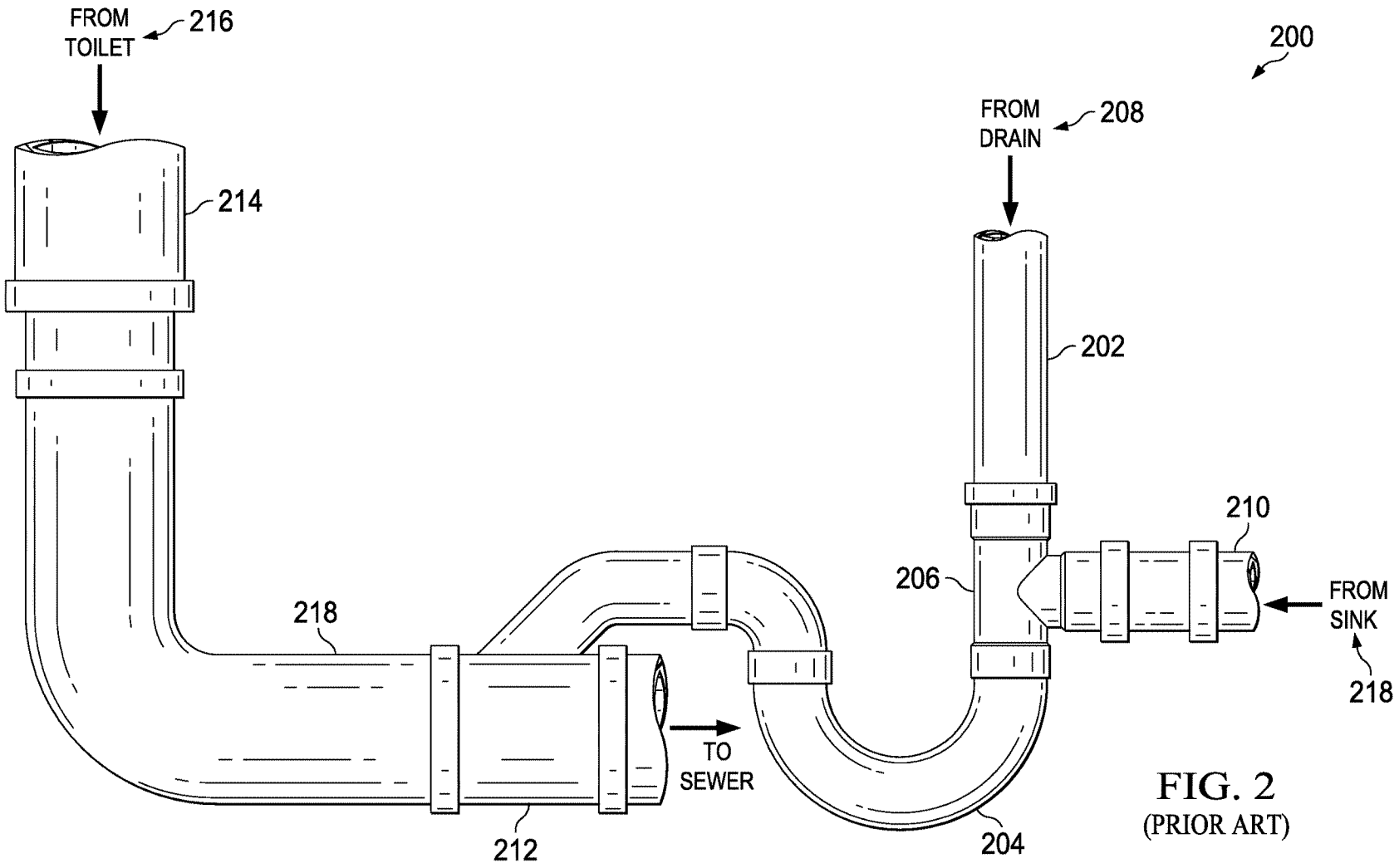
FIG. 2 (PRIOR ART)
FIG. 2 depicts an elevational view of a second prior art floor drain installation.

FIG. 2 depicts an elevational view of a second prior art floor drain installation 200. The second prior art drain installation 200 may comprise a first drain pipe 202 extending upwardly from a connection 206 and a plumbing trap 204 to a fixture, such as a floor drain 208. The connection 206 may also connect to a second drain pipe 210, which may be connected to a second fixture, such as a sink 218. A connection 212 may be connected to the plumbing trap 204 at a second end. A third drain pipe 214 may extend from the connection 212, which may be connected to an elbow 218 and a third fixture, such as a toilet 216. A drain outlet (not shown) may also extend from the second connection 212 and may be connected to the main sewer line. In an embodiment, the first and second connections 206, 218 may be T- or Y-shaped connections. Before the installation 200 is completed, the drain pipes 202 and 214 extend above a flooring slab and must be cut to appropriate lengths to allow the fixtures to sit flush with or on a finished flooring surface.

As depicted in FIGS. 1 and 2, after installation, the fixtures 108, 208, and 216 preferably sit flush with or on a finished flooring surface 112 installed above a concrete slab 110. In order to make such a prior art installation 100, 200, however, a plumber will install the sub-floor plumbing components and then leave the drain pipes 102, 202 extending above an estimated floor height that will extend to a desired fixture. Then, a flooring specialist will finish the flooring above the sub-floor plumbing. Concrete 110 is often poured around the drain pipe and then the finished flooring surface 112 is installed above the concrete 110. Once the concrete 110 is poured, however, it is difficult, if not impossible, to remove the drain pipes 102, 202 in order to cut them to the proper height. In order to cut the drain pipes 102, 202 below the flooring surface after the concrete 110 is poured, the flooring specialist must chisel the concrete 110 around the drain pipes 102, 202 so that there is sufficient clearance for tools to cut the drain pipes 102, 202 below the finished flooring surface 112, which can be a difficult process. But if the drain pipes 102, 202 are cut before the concrete 110 is poured, it is difficult to determine the desired length of the drain pipes 102, 202.

Figure 3:
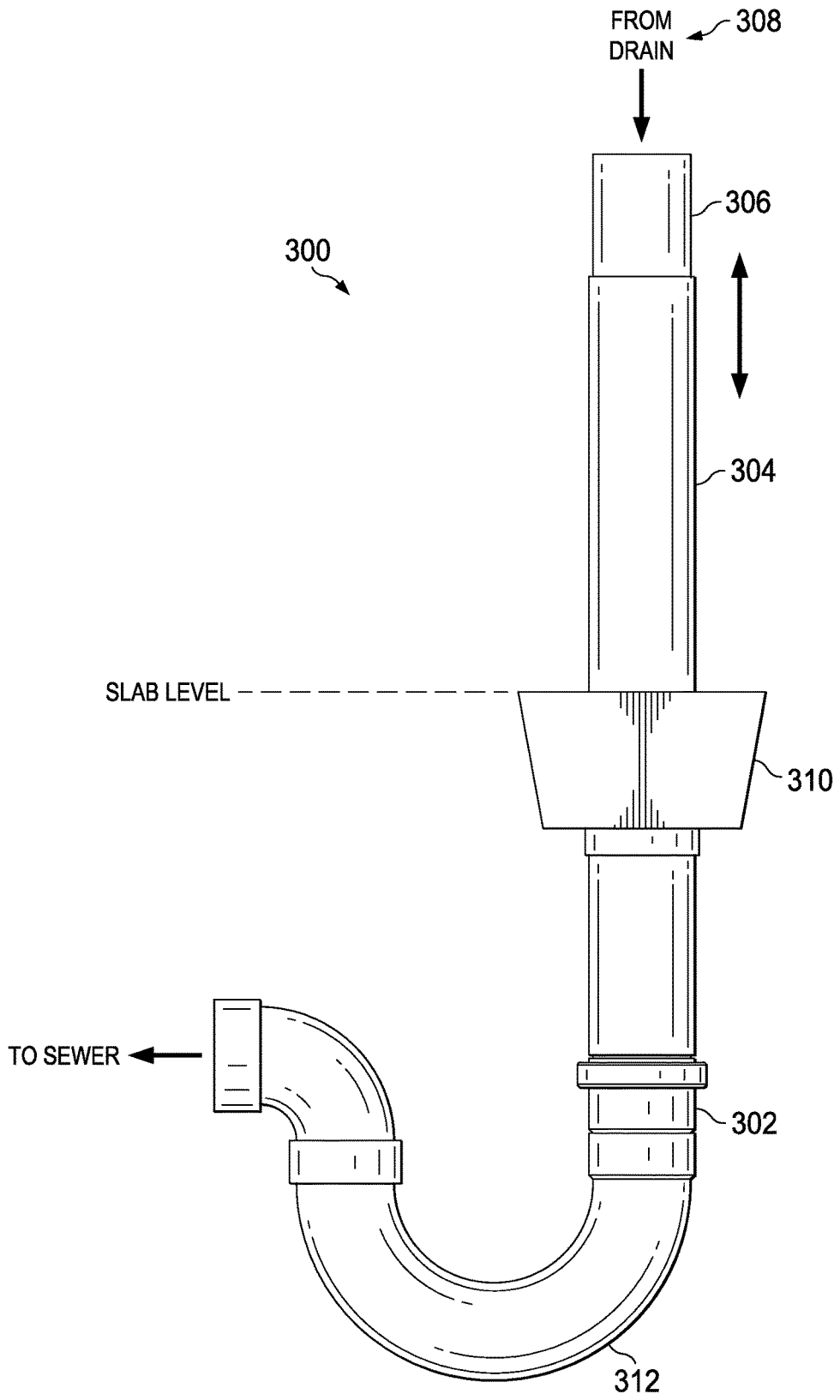
FIG. 3 depicts an perspective view of an improved drain installation, in accordance with one embodiment of the present disclosure.
Figure 4:
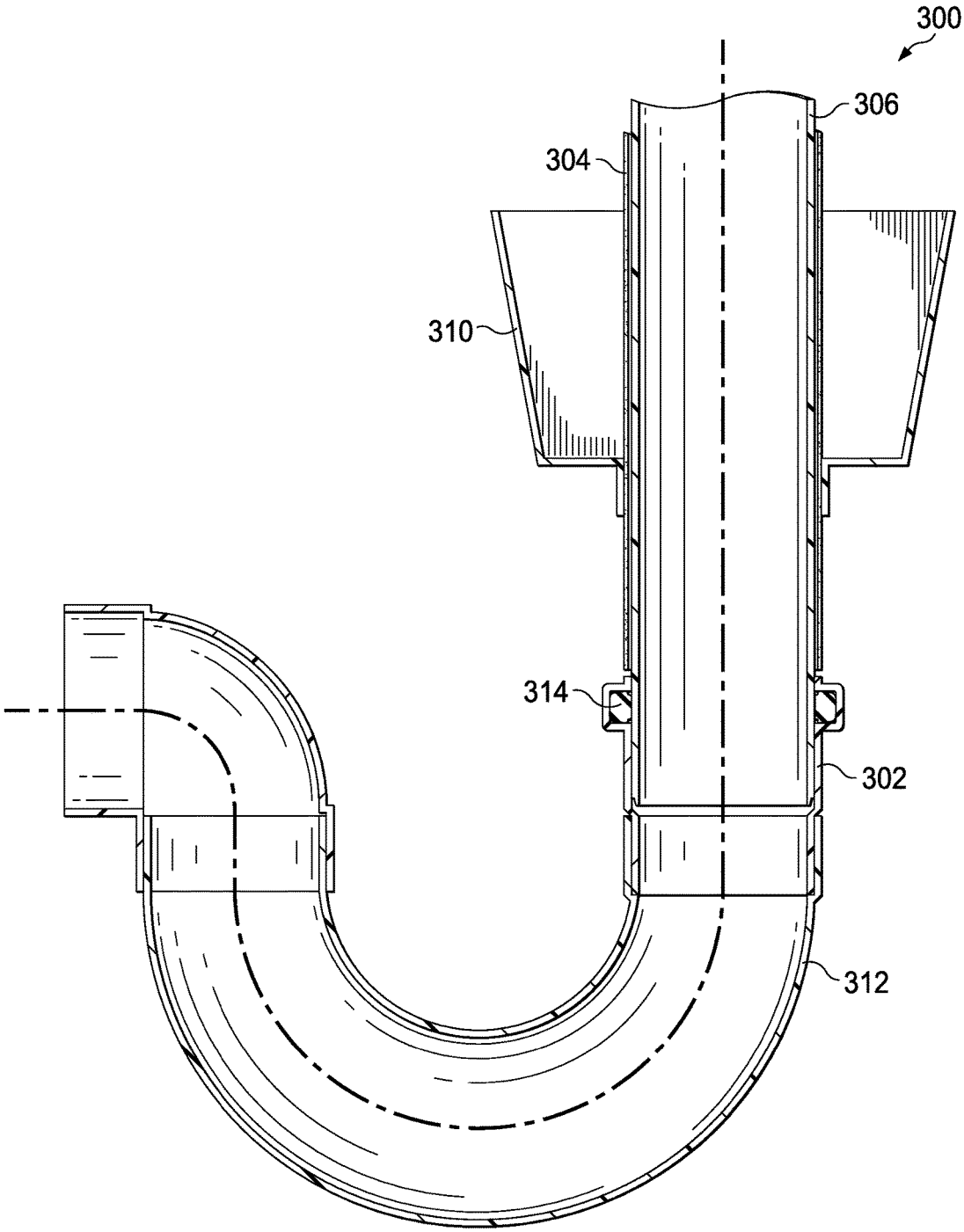
FIG. 4 depicts a cutaway view of the improved drain installation of FIG. 3, in accordance with one embodiment of the present disclosure.
Figure 5:
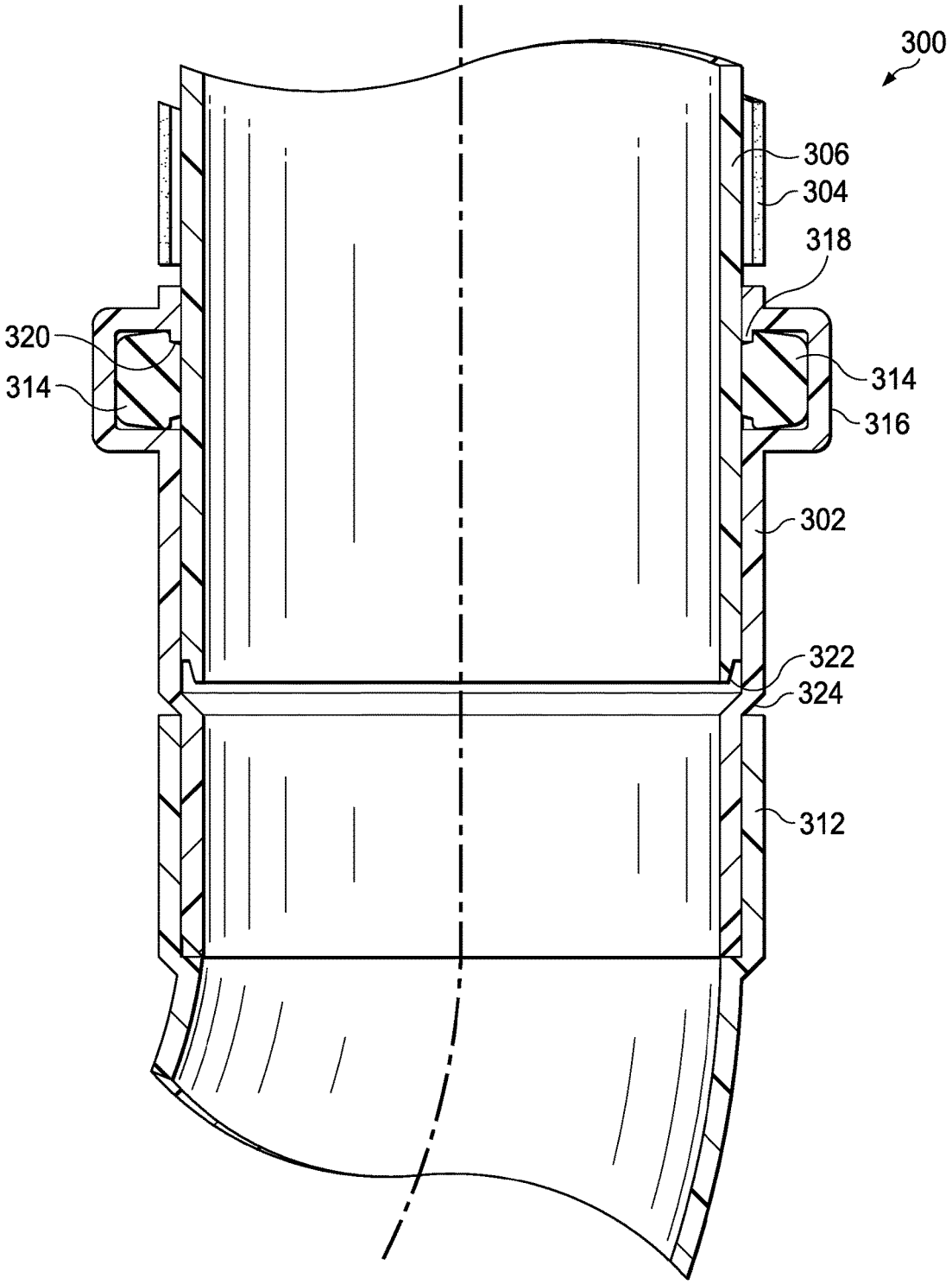
FIG. 5 depicts a depicts a magnified cutaway view of the improved drain installation of FIG. 4, in accordance with one embodiment of the present disclosure.

FIG. 3 depicts a perspective view of an improved drain installation 300, in accordance with one embodiment of the present disclosure. FIG. 4 depicts a cutaway view of the improved drain installation 300 of FIG. 3, in accordance with one embodiment of the present disclosure. FIG. 5 depicts a magnified cutaway view of the improved drain installation 300 of FIG. 4, in accordance with one embodiment of the present disclosure.

As shown in FIGS. 3-5, the improved drain installation 300 may include a plumbing trap 312. In an embodiment, the plumbing trap 312 may be an integral U-shaped trap, although in other embodiments, it may be an S- or J-shaped trap. In an embodiment, an adapter 302 may be removably or permanently connected to a first end of the plumbing trap 312 at a first end of the adapter 302. In other embodiments, the adapter 302 may be internally, or integrally, formed and may be configured to be received within the first end of the plumbing trap 312 at a first end of the adapter 302. In other embodiments, an adapter may not be required. A drain outlet (not shown) may be removably or permanently connected to a second end of the plumbing trap 312 and the drain outlet may be connected to the main sewer line (also not shown). The drain outlet, the plumbing trap 312, and/or the adapter 302 may be permanently connected to each other with a plumbing cement or adhesive or may be removably connected to each other through a friction-fit type of engagement seal.

The improved drain installation 300 may further comprise a removable drain pipe 306, which may be connected to a first end of the plumbing trap 312 at a first end of the removable drain pipe 306.

The improved drain installation 300 may further comprise a sleeve 304 received around the removable drain pipe 306 and may extend to approximately an end of the removable drain pipe 306. Both the removable drain pipe 306 and the sleeve 304 may extend above a slab level of a flooring surface, requiring the removable drain pipe 306 to be cut to size before a fixture 308 may be attached to the end of the removable drain pipe 306. In an embodiment, the fixture 308 may be a floor drain or a shower drain. In an embodiment, the sleeve 304 may be a disposable sleeve or a reusable sleeve.

In some embodiments, an adapter 302 may be received between the plumbing trap 312 and the removable drain pipe 306. In such embodiments, the plumbing trap 312 may be received within a first end of the adapter 302 and the removable drain pipe 306 may be received within a second end of the adapter 302. A washer 314 may be received between the removable drain pipe 306 and the adapter 302 at the second end of the adapter 302 and may provide a seal between the removable drain pipe 306 and the adapter 302 such that gases and liquids cannot escape between the two. The first end of the removable drain pipe 306 may further comprise an angled end 322.

The adapter 302 may be shaped with a first diameter at its first end and a second, larger diameter at its second end connected by an angled transition 324 between the two. The first diameter at the first end may be sized and shaped to fit within the first end of the plumbing trap 312. The second diameter at the second end may be sized and shaped to receive the removable drain pipe 306. When inserted into the adapter 302, the angled first end 322 of the removable drain pipe 306 may interact with, but not pass beyond, the angled transition 324 of the adapter 302. The second end of the adapter 302 may further comprise an enclosed circumferential shoulder 316 operable to receive the washer 314 within the shoulder. The shoulder 316 may be sized and shaped to mate with the washer 314 and may include a circumferential lower lip 318 operable to engage with an inner circumferential shoulder 320 of the washer 314.

In FIGS. 3-5, the fixture 308 depicted is a floor drain. When installing a floor drain, unlike when installing a toilet or a sink, the removable drain pipe 306 is cut below the flooring surface so that the floor drain can sit flush with the flooring surface, allowing the water to drain. With a floor drain, an optional pre-form 310 may be used and received around the sleeve 304 and the removable drain pipe 306. The optional pre-form 310 may be shaped to correspond to the shape of the desired floor drain fixture 308.

During installation, both a plumber and a flooring specialist may be needed to properly install the improved drain installation 300. The plumber may first connect the plumbing trap 312 to the main drain outlet (not shown) that is connected to the sewer main (also not shown) below the flooring slab level. Next, the plumber may insert the washer 314 into the shoulder 316 of the adapter 302, or the washer 314 may be pre-installed into the shoulder 316, and connect the adapter 302 to the first end of the plumbing trap 312. The adapter 302 is operable to be inserted into the first end of the plumbing trap 312 at the first end of the adapter 302. Next, the plumber may connect the removable drain pipe 306 to the second end of the adapter 302. In an embodiment, the shoulder 316 may be received in the adapter 302 or in the integrally-formed P-shaped trap. The removable drain pipe 306 is operable to be inserted into the second end of the adapter 302, creating a seal between the removable drain pipe 306 and the adapter 302 at the washer 314. If an adapter is not desired, the plumber may connect the removable drain pipe 306 to the first end of the plumbing trap 312. The shoulder 316 and the washer 314 may be integrally formed at the first end of the plumbing trap 312. Once the removable drain pipe 306 has been connected to either the plumbing trap 312 or the adapter 302, the plumber may slide the sleeve 304 over the removable drain pipe 306. The sleeve 304 may be slid downwardly and proximate to the plumbing trap 312 or the adapter 302. If the fixture 308 being installed is a floor drain, the plumber may then slide the pre-form 310 over both the sleeve 304 and the removable drain pipe 306. The pre-form 310 may be slid downwardly so that an upper edge of the pre-form 310 is approximately level with the eventual height of the flooring slab level. Once the sub-floor plumbing is complete, the plumber may transition the project to the flooring specialist.

Next the flooring specialist may build the floor above the sub-floor and around the sleeve 304 and the removable drain pipe 306. The flooring specialist may start with a concrete or wood sub-floor (not shown) and then build a finished flooring surface (also not shown) above the sub-floor. The finished flooring surface may be made from tile, wood, finished concrete, or the like and may be various thicknesses based on the chosen finished flooring surface. The sub-floor and the finished flooring surface may extend entirely around the sleeve 304. Once the flooring is complete, the flooring specialist may finish the installation of the plumbing fixture 308 or may transition the project back to the plumber to finish installation of the plumbing fixture 308.

In the improved installation process, the flooring specialist or the plumber does not need to alter the finished flooring surface in any way in order to cut the removable drain pipe 306 to the desired height. Unlike the prior art methods, which required the flooring specialist or the plumber to chisel the flooring surface or to guestimate the desired height of the drain pipe, the current installation process allows the flooring specialist or the plumber to precisely cut the removable drain pipe 306 to the desired height without needing to chisel the sub-floor.

In order to finish installation of the plumbing fixture 308 in the improved installation process, either the flooring specialist or the plumber can mark the desired height of the removable drain pipe 306 or measure the distance from the end of the removable drain pipe 306 to the finished flooring surface. Next, either the flooring specialist or the plumber can remove the removable drain pipe 306 from the plumbing trap 312 or the adapter 302, while leaving the sleeve 304 in place relative to the sub-floor and the finished flooring surface. The sleeve 304 acts as an insulator between the removable drain pipe 306 and the sub-floor and the finished flooring surface and eliminates the traditional adhesive interaction that would be present between concrete and a traditional drain pipe. The sleeve 304 can be made from cardboard, wax paper, plastic, or any other insulating material.

Once the removable drain pipe 306 is removed partly or entirely from the sleeve 304 and the removable drain pipe 306 is cut to the proper length, while the sleeve 304 maintains and secures the aperture to allow the removable drain pipe 306 to be re-inserted through the sleeve 304.

After cutting the removable drain pipe 306 to the proper length, either the flooring specialist or the plumber may re-insert the removable drain pipe 306 through the sleeve 304 and into either the plumbing trap 312 or the adapter 302.

If an adapter is desired, the removable drain pipe 306 may be inserted into the sleeve 304 until the angled end 322 of removable drain pipe 306 interacts with the angled transition 324 of the adapter 302. Once re-inserted, the washer 314 again creates a seal between the adapter 302 and the removable drain pipe 306. During both removal and re-insertion of the removable drain pipe 306, the washer 314 may move within the shoulder 316 of the adapter 302, but if present, the circumferential lip 318 and circumferential shoulder 320 arrangement prevent the washer 314 from being removed from the shoulder 316.

Before the removable drain pipe 306 is re-inserted into the plumbing trap 312 and a proper seal is created, the flooring specialist may remove the sleeve 304 from between the sub-floor and finished flooring surface. If the fixture being installed is a floor drain, the pre-form 310 may also be removed, leaving an opening the same size and shape as the desired floor drain.

Once the removable drain pipe 306 has been cut to the desired length, and re-inserted into the trap 312, the flooring specialist can install the desired plumbing fixture 308. The plumbing fixture 308 may create a seal between the end of the removable drain pipe 306 and the finished flooring surface, or the plumber may create a seal (or additional seal) with caulk or another similar sealing material.

Figure 6:
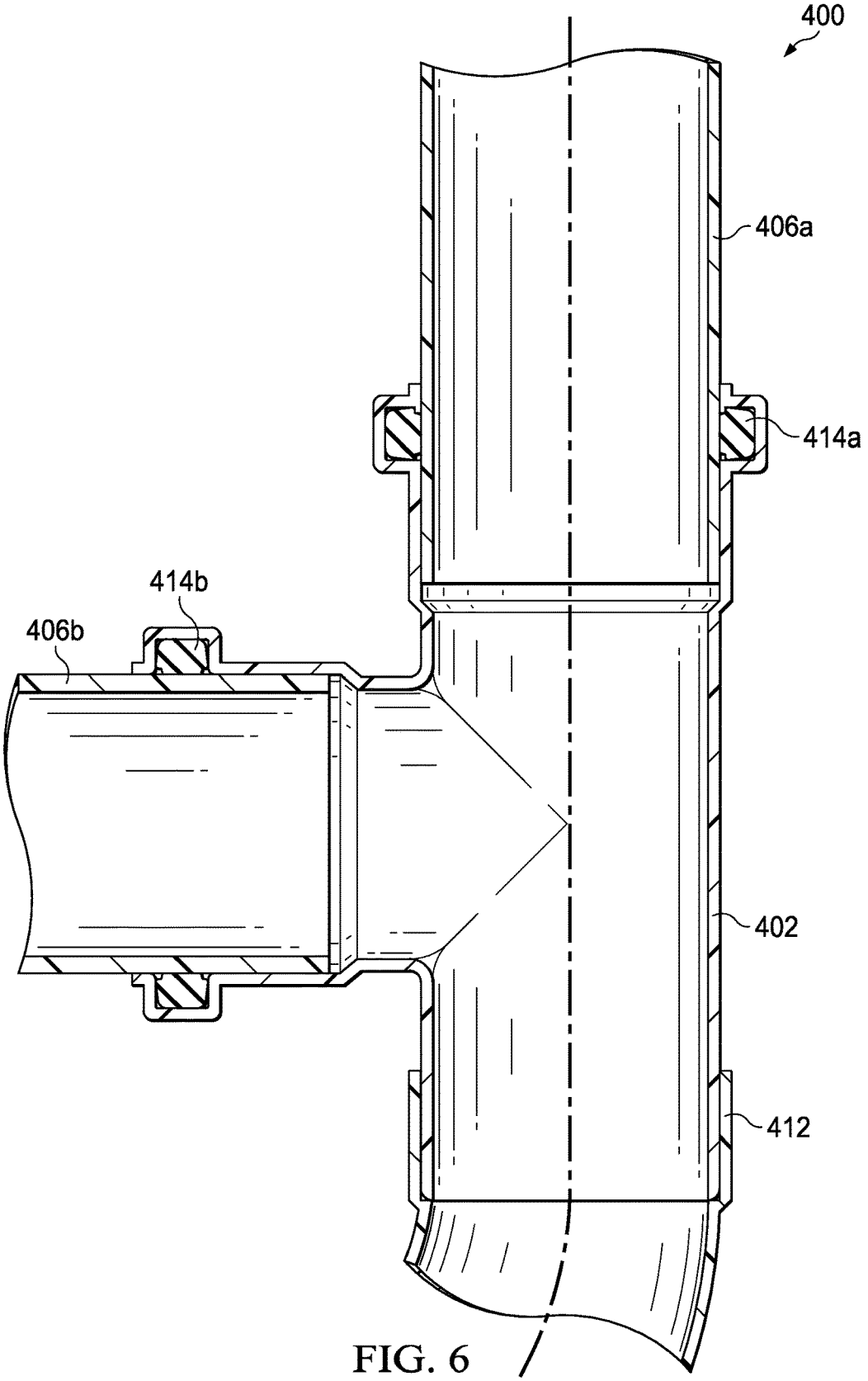
FIG. 6 depicts a cutaway view of an improved drain installation, in accordance with one embodiment of the present disclosure.

FIG. 6 depicts a cutaway view of an improved drain installation 400, in accordance with one embodiment of the present disclosure. Like the drain installation depicted in FIGS. 3-5, the improved drain installation 400 may include a plumbing trap 412. In an embodiment, the plumbing trap 412 may be an integral U-shaped trap, although in other embodiments, it may be an S- or J-shaped trap. A T-shaped adapter 402 may be connected to a first end of the plumbing trap 412 and may be configured to be received within the first end of the plumbing trap 412 at a first end of the T-shaped adapter 402. The T-shaped adapter 402 allows two plumbing fixtures to be installed in close proximity to each other, such as a floor drain and a sink in a bathroom, and connect to a single plumbing trap 412. An outlet pipe (not shown) may be connected to a second end of the plumbing trap 412 and the outlet pipe may be connected to the main sewer line (also not shown).

The improved drain installation 400 may further comprise a removable drain pipe **406*a* connected to a second end of the T-shaped adapter 402. The removable drain pipe 406*a* may be configured to be received within a shoulder formed in the second end of the T-shaped adapter 402. Washers 414*a* may be received between the removable drain pipe 406*a* and the T-shaped adapter 402 at the second end of the T-shaped adapter 402 and may provide a seal between the removable drain pipe 406*a* and the T-shaped adapter 402** such that gases and liquids cannot escape between the two.

The improved drain installation 400 may further comprise a secondary inlet pipe 406 connected to a third end of the T-shaped adapter 402. The secondary inlet pipe 406 may be configured to be received within a shoulder formed in the third end of the T-shaped adapter 402. Washer 414*b* may be received between the secondary inlet pipe 406*b* and the T-shaped adapter 402 at the third end of the T-shaped adapter 402 and may provide a seal between the secondary inlet pipe 406 and the T-shaped adapter 402 such that gases and liquids cannot escape between the two.

The improved drain installation 400 may further comprise one or more sleeves (not shown) received around the removable drain pipe 406*a* and may extend from proximate to the second and third ends of the T-shaped adapter 402 to approximately ends of the removable drain pipe 406*a*. The removable drain pipe 406*a* and the sleeve may extend above a slab level of a flooring surface, requiring the removable drain pipe 406*a* to be cut to size before fixtures may be attached to the end of the removable drain pipe 406*a*. In an embodiment, the fixtures may be floor drains, shower drains, or a combination thereof. The method of installing the improved drain installation 400 is similar to that described above in relation to the installation of the improved drain installation 300.

Figure 7:
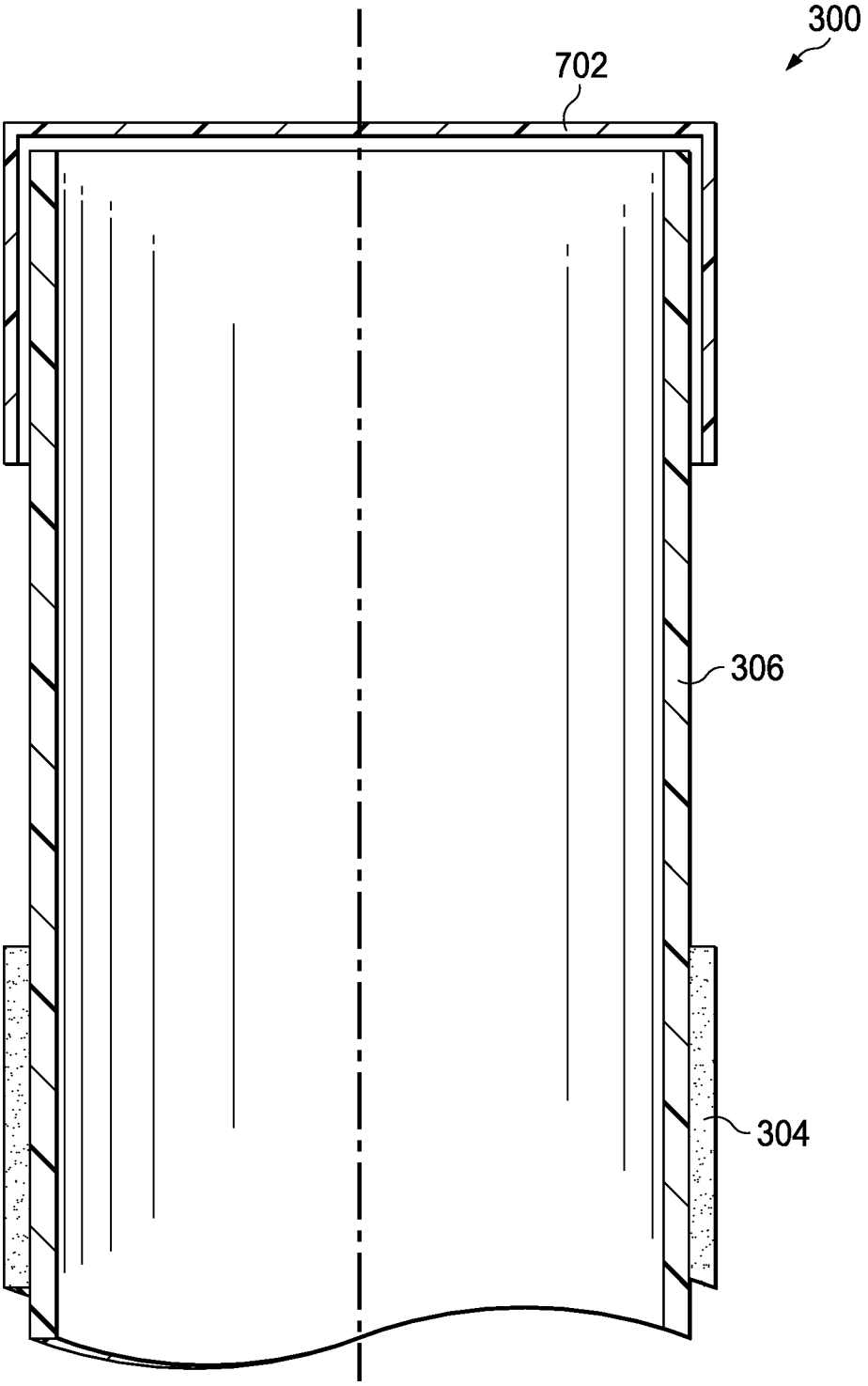
FIG. 7 depicts a cutaway view of the improved drain installation of FIG. 3, in accordance with one embodiment of the present disclosure.

FIG. 7 depicts a cutaway view of the improved drain installation 300 of FIG. 3, in accordance with one embodiment of the present disclosure. As shown in FIG. 7, the removable drain pipe 306 may be encircled by the sleeve 304, but may further comprise an end cap 702. The end cap 702 may be placed on the open second end of the removable drain pipe 306 and may cap the removable drain pipe 306 so that gases and liquids do not escape into the room.

Figure 8A:
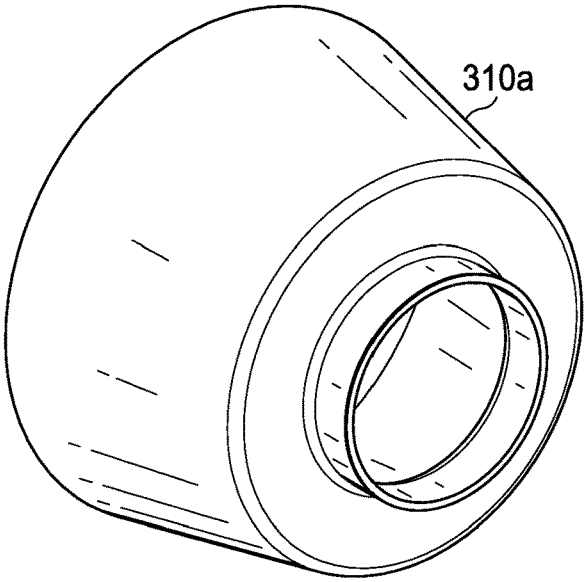
FIG. 8A depicts a perspective view of a first pre-form of the improved drain installation of FIG. 3, in accordance with one embodiment of the present disclosure.
Figure 8B:
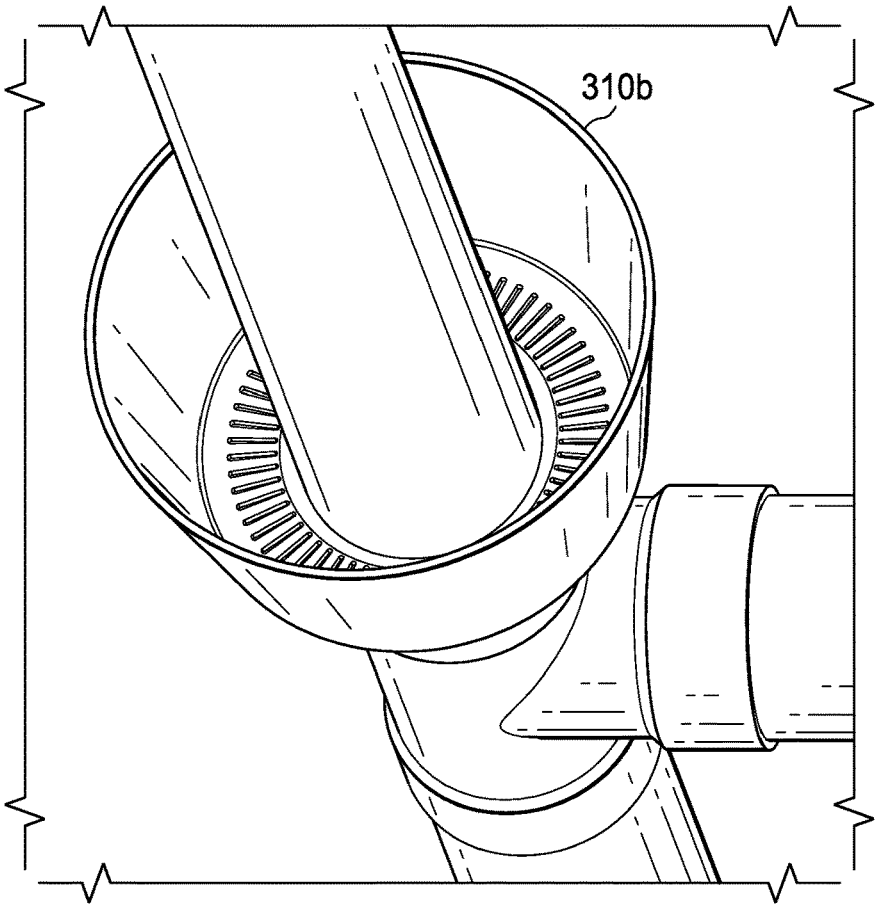
FIG. 8B depicts a perspective view of a second pre-form of the improved drain installation of FIG. 3, in accordance with one embodiment of the present disclosure.

FIG. 8A depicts a perspective view of a first pre-form 310*a* of the improved drain installation of FIG. 3, in accordance with one embodiment of the present disclosure. FIG. 8B depicts a perspective view of a second pre-form 310*b* of the improved drain installation of FIG. 3, in accordance with one embodiment of the present disclosure. The pre-forms 310*a*, 310*b* may be sized and shaped to fit a desired floor drain and may be round, square, tapered, etc. The pre-forms 310*a*, 310*b* may advantageously prevent concrete from falling within the drain pipe and into the plumbing trap during installation.

Figure 9:
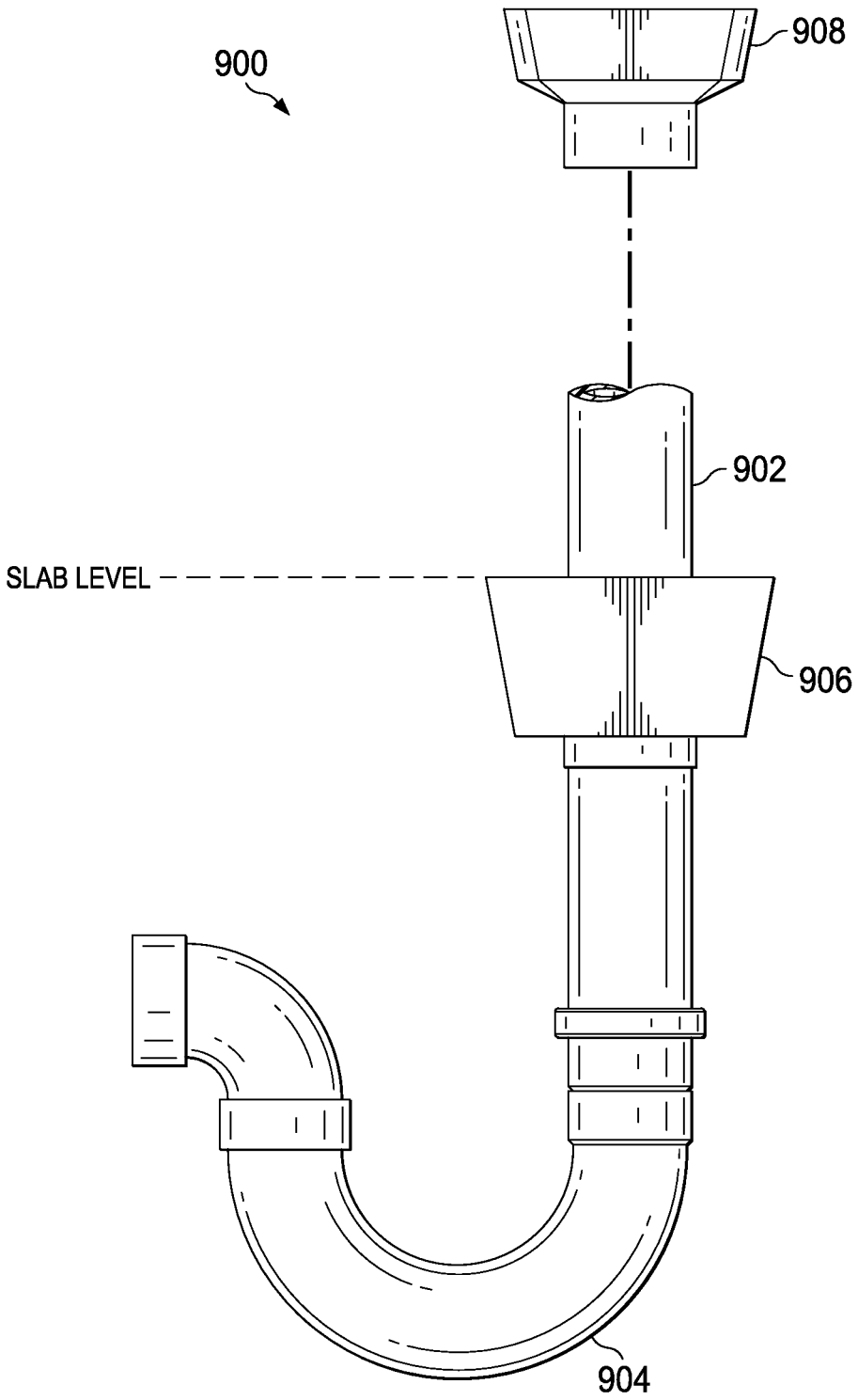
FIG. 9 depicts an perspective view of an improved drain installation, in accordance with one embodiment of the present disclosure.

FIG. 9 depicts an perspective view of an improved drain installation 900, in accordance with one embodiment of the present disclosure. In an embodiment, a first end of a drain pipe 902 may be connected to a first end of a plumbing trap 904 and a drain pre-form 906 may be received around a second end of the drain pipe 902. The first end of the drain pipe 902 may be cemented into the plumbing trap 904, while the drain pre-form 906 may be received around the second end of the drain pipe 902 and is operable to slide up and down the length of the drain pipe 902. In addition, the drain pre-form 906 is operable to be removed from the second end of the drain pipe 902.

In an embodiment, the drain pipe 902 may be cut to a desired length so that a floor drain 908 sits below a finished flooring level, and may be cut on-site or may be pre-cut to raise the drain pre-form 906 to a desired height above the plumbing trap 904. A plumber may slide the drain pre-form 906 downwardly around the drain pipe 902 to an approximate height of a finished flooring surface. The drain pre-form 906 may be sized and shaped to fit a desired floor drain and may be round, square, tapered, etc. The pre-form 906 may advantageously prevent concrete from falling within the drain pipe and into the plumbing trap during installation.

In operation, after the plumber installs the sub-floor plumbing—i.e., the drain pipe 902, the plumbing trap 904, and the drain pre-form 906—and the concrete slab has been poured around the sub-floor plumbing, a flooring specialist may install the finished flooring surface above the concrete slab and finish the installation of the drain. After the finished flooring surface has been laid to a desired height, which is preferably slightly above an upper surface of the drain pre-form 906, the flooring specialist may remove the drain pre-form 906 from the second end of the drain pipe 902 and cut the drain pipe 902 to a desired length. In order to cut the drain pipe 902 to a desired length after the finished flooring surface is installed, a specialty tool, such as a PVC wire saw, may be needed to cut the drain pipe 902 without damaging the finished flooring surface or the drain pipe 902. After cutting the drain pipe 902 to the desired length, the flooring specialist may cement the floor drain 908 into the second end of the drain pipe 902 so that an upper surface of the floor drain 908 may be flush, or slightly below, a surface of the finished flooring surface.

As disclosed herein, the plumbing traps and removable drain pipes may be constructed from PVC, ABS, cast iron, brass, copper, or any other material suitable for plumbing pipes. Similarly, the adapter and T-shaped adapter may be constructed from PVC, ABS, cast iron, brass, copper, or any other material suitable for plumbing pipe adapters. The washers may be constructed from plastic, foam, or any other material suitable to provide a seal between the removable drain pipes and the adapters. As discussed previously, the sleeve may be constructed from cardboard, wax paper, plastic, or any other non-adhesive material suitable to permit the removable drain pipe not to adhere to the sub-floor concrete and to allow movement of the removable drain pipes relative to the flooring. The cap may be constructed from PVC, ABS, cast iron, brass, copper, or any other material suitable for capping a plumbing pipe. Each of the components described herein may be sized and shaped to meet the plumbing needs of each individual plumbing fixture installation.

It should be appreciated that the breadth and scope of the invention(s) is not limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

The invention claimed is:

1. A method of installing a drain fixture, the method comprising:

installing a sub-floor plumbing system comprising:

connecting a first end of a plumbing trap to a main drain outlet;

connecting a first end of an adapter to a second end of the plumbing trap;

connecting a first end of a removable drain pipe to a second end of the adapter; and sliding a sleeve over the removable drain pipe proximate to the plumbing trap;

building a flooring surface proximate to the plumbing trap, the removable drain pipe, and the sleeve;

at least partly removing the removable drain pipe from the sleeve;

cutting the removable drain pipe to a desired length; and re-inserting the removable drain pipe into the sleeve thereby connecting the first end of the removable drain pipe to the second end of the adapter.

2. The method of claim 1, further comprising, and before connecting the first end of the removable drain pipe to the second end of the adapter, inserting a washer into a shoulder defined in the second end of the adapter.

3. The method of claim 2, wherein connecting the first end of the removable drain pipe to the second end of the adapter further comprises creating a seal between the removable drain pipe and the adapter with the washer.

4. The method of claim 1, further comprising installing a plumbing fixture to a second end of the removable drain pipe.

5. The method of claim 4, further comprising creating a seal between the plumbing fixture and the second end of the removable drain pipe.

6. The method of claim 4, further comprising creating a seal between the flooring surface, the plumbing fixture, and the second end of the removable drain pipe.

7. The method of claim 1, further comprising installing a floor drain to a second end of the removable drain pipe.

8. The method of claim 1, further comprising, and after sliding the sleeve over the removable drain pipe proximate to the plumbing trap, positioning a drain pre-form over the sleeve and the removable drain pipe in a position approximate to a flooring slab level.

9. The method of claim 8, further comprising, and after re-inserting the removable drain pipe and connecting the first end of the removable drain pipe to the second end of the adapter, removing the drain pre-form.

10. The method of claim 8, further comprising, and before re-inserting the removable drain pipe and connecting the first end of the removable drain pipe to the second end of the adapter, removing the drain pre-form.

11. The method of claim 1, further comprising installing a shower drain to a second end of the removable drain pipe.

12. The method of claim 1, wherein the adapter is a T-adapter operable to connect to the plumbing trap and the removable drain pipe.

13. The method of claim 1, wherein the sleeve is a disposable sleeve or a reusable sleeve.

14. The method of claim 1, wherein the re-inserting includes inserting the removable drain pipe into an opening of the flooring surface.

15. The method of claim 1, wherein the step of sliding the sleeve over the removable drain pipe proximate to the plumbing trap comprises sliding the sleeve over the removable drain pipe such that an upper distal end of the sleeve is lower than an upper distal end of the removable drain pipe.

16. The method of claim 1, wherein the sleeve insulates the removable drain pipe from the flooring surface.

* * * * *